United States Patent [19]

Ishihara et al.

[11] Patent Number: 4,889,687

[45] Date of Patent: Dec. 26, 1989

[54] NODULAR CAST IRON HAVING A HIGH IMPACT STRENGTH AND PROCESS OF TREATING THE SAME

[75] Inventors: Yasuoki Ishihara; Fumio Obato, both of Fukuoka; Jun Sakai; Takeshi Natsume, both of Saitama, all of Japan

[73] Assignees: Hitachi Metals, Ltd.; Honda Giken Kogyo K.K., both of Japan

[21] Appl. No.: 165,873

[22] Filed: Mar. 9, 1988

[30] Foreign Application Priority Data

| | | | |
|---|---|---|---|
| Mar. 9, 1987 | [JP] | Japan | 62-052205 |
| Mar. 9, 1987 | [JP] | Japan | 62-052206 |
| Dec. 23, 1987 | [JP] | Japan | 62-323812 |
| Dec. 23, 1987 | [JP] | Japan | 62-323813 |

[51] Int. Cl.[4] ..... C22C 37/04

[52] U.S. Cl. ..... 420/13; 420/15; 420/16; 420/27; 420/29; 148/3; 148/139

[58] Field of Search ..... 420/13–16, 420/29; 148/321, 3, 139

[56] References Cited

FOREIGN PATENT DOCUMENTS

| | | | |
|---|---|---|---|
| 5544560 | 8/1930 | Japan | 420/13 |
| 59-17183 | 4/1984 | Japan . | |
| 61-33897 | 8/1986 | Japan . | |
| 998561 | 2/1983 | U.S.S.R. | 148/321 |
| 1065492 | 1/1984 | U.S.S.R. | 420/16 |

*Primary Examiner*—Deborah Yee

*Attorney, Agent, or Firm*—Skjerven, Morrill, MacPherson, Franklin & Friel

[57] ABSTRACT

Nodular cast iron having favorable mechanical properties, in particular a high impact strength at low temperatures, comprising: from 3.0 to 4.0% of carbon; from 1.5 to 2.3% of silicon; less than 0.3% of manganese; not more than 0.03% of phosphorus; less than 0.10% of chromium; from 0.02 to 0.06% of magnesium; and from 0.0015 to 0.0150 weight % of bismuth with the balance consisting of iron and inevitable impurities and the CE (carbon equivalent) value being from 3.9 to 4.6%. This material is characterized by a low silicon content. Adding from 0.5 to 2.0% of nickel thereto improves its tensile strength and yield strength. Preferably, from 0.005 to 0.03% of bismuth is added to this nodular cast iron in molten state so as to produce more than 300 graphite nodules per $mm^2$. The remaining bismuth content is preferably from 0.0015 to 0.015%, more preferably from 0.0015 to 0.004%. The resulting nodular cast iron has improved mechanical properties, in particular a high low temperature impact strength and can be used either as cast or after a ferritizing process.

16 Claims, 13 Drawing Sheets

0.53%Ni

PRESENT INVENTION

X 100

1.05%Ni

PRESENT INVENTION

X 100

1.98%Ni

PRESENT INVENTION

X 100

FCD40

CONVENTIONAL

X 100

FCD60

CONVENTIONAL

X 100

0.53%Ni

X 100

PRESENT INVENTION 1.05%Ni

X 100

PRESENT INVENTION 1.98%Ni

X 100

PRESENT INVENTION

FCD40

(AFTER HEAT TREATMENT)

X 100

CONVENTIONAL 0.51%Ni

X 100

PRESENT INVENTION 1.03%Ni

X 100

PRESENT INVENTION 2.00%Ni

X 100

PRESENT INVENTION 0.51%Ni

X 100

PRESENT INVENTION 1.03%Ni

X 100

PRESENT INVENTION 2.00%Ni

X 100

PRESENT INVENTION

X 100

PRESENT INVENTION

X 100

FCD40

X 100

LOW-Si FCD40

X 100

Bi-ADDED FCD40

0.0010
(88.5)

0.0020
(90.5)

0.0025
(91.2)

0.0035
(90.0)

0.0042
(90.4)

0.0045
(87.6)

0.0053
(87.0)

0.0060
(85.0)

0.0068
(82.7)

0.0079
(79.0)

0.0090
(72.0)

0.0096
(70.5)

NODULAR CAST IRON HAVING A HIGH IMPACT STRENGTH AND PROCESS OF TREATING THE SAME

TECHNICAL FIELD

The present invention relates to nodular cast iron having a high toughness, in particular a high impact strength at low temperatures.

BACKGROUND OF THE INVENTION

Conventional nodular cast iron having a ferrite background or ferritic nodular cast iron, such as FCD37 and FCD40 (JIS G5502—Spheroidal Graphite Iron Castings) demonstrates a large elongation and high impact strength but has a low tensile strength and poor low-temperature impact strength. On the other hand, nodular cast iron having a pearlite background or pearlitic nodular cast iron, such as FCD50 and FCD60 (JIS G5502), has a high tensile strength and yield strength but demonstrates a relatively small elongation and low impact strength, particularly at low temperatures.

Component parts made of cast iron for automotive and other industrial uses are now desired to have an even higher toughness and, additionally, as they are sometimes used at as low a temperature as approximately −40 ° C., are now required to maintain a high impact strength even at such low temperatures.

To the end of making improvements in this respect, Japanese Patent Publication No. 61-33897 proposes the addition of nickel to the nodular graphite cast iron. However, the impact strength of the nodular cast iron based on this proposal is limited only to 1.7 kgf-m/cm$^2$ at −15 ° C. Furthermore, according to this proposal, the material is required to have a completely ferritic structure. Therefore, a ferritizing process is required to be performed subsequent to the casting process, but, in view of reducing the manufacturing cost, it is more desirable to do away with any such heat treatment subsequent to the casting process and permit the use of the component parts made of nodular cast iron as cast.

Japanese Patent Publication No. 59-17183 filed by one of the assignees (applicants) of the present application discloses a nodular cast iron which contains nickel and can be used as cast without any heat treatment.

U.S. Pat. No. 4,432,793 recommends the use of a substantially large dosage of bismuth in nodular cast iron for obviating the need for heat treatment.

BRIEF SUMMARY OF THE PRESENT INVENTION

The present invention is based on the discovery that the tensile strength and the yield strength of nodular cast iron can be increased by adding nickel thereto and, additionally, that the elongation and the impact strength can be improved by keeping the content of silicon at a low level. The Inventors have also discovered that by adjusting the number of graphite nodules to be greater than 300 /mm$^2$ by addition of a small amount of bismuth to the nodular cast iron in molten state, the amount of pearlite is reduced and, even without any heat treatment, or at most with a heat treatment of a short time duration, a sufficient elongation and impact strength can be obtained. It goes without saying that, if the background is converted into a ferrite structure by ferritization, an even greater elongation and higher toughness can be obtained.

Thus, a primary object of the present invention is to provide nodular cast iron having an improved elongation, tensile strength, yield strength and impact strength, in particular an improved impact strength at low temperatures.

A second object of the present invention is to provide nodular cast iron having improved mechanical properties and not requiring any heat treatment or, at most, requiring a heat treatment of only a short time duration so as to reduce the manufacturing cost.

These and other objects of the present invention can be accomplished by providing nodular cast iron, comprising: from 3.0 to 4.0 weight % of carbon; from 1.5 to 2.3 weight % of silicon; less than 0.3 weight 5 of manganese; not more than 0.03 weight % of phosphorus; less than 0.10 weight % of chromium; and from 0.02 to 0.06 weight % of magnesium; and from 0.0015 to 0.015 weight % of bismuth; with the balance consisting of iron and inevitable impurities and the CE (carbon equivalent) value being from 3.9 to 4.6%. This bismuth content can be achieved by adding from 0.005 to 0.03 weight % of bismuth to the nodular cast iron, having the above mentioned composition minus bismuth, in molten state so that the number of graphite nodules therein is adjusted to be greater than 300 per mm$^2$ by inoculation at the same time as or after the addition of bismuth. Additionally, the final bismuth content may range from 0.0015 to 0.015% and more preferably from 0.0015 to 0.004 weight %. The mechanical properties of this nodular cast iron can be further improved by adding from 0.5 to 2.0 weight % of nickel thereto.

Now the bases for the above mentioned numerical values of the contents of the various elements are discussed in the following.

When the carbon content is less than 3.0%, the castability is impaired and the pearlite content increases due to reduction in the number of graphite nodules. On the other hand, if the carbon content exceeds 4.0%, kish graphite is produced and the mechanical strength is thereby reduced.

When the silicon content is less than 1.5%, carbides tend to precipitate and the impact strength and elongation properties are impaired. When the silicon content exceeds 2.3%, the impact strength and elongation are impaired due to the presence of silicoferrite.

When the manganese content exceeds 0.3%, the pearlite content increases and the impact strength and the elongation are reduced. When the phosphorus content exceeds 0.03%, the impact strength and elongation are impaired due to the presence of steadite.

When the nickel content is less than 0.05%, the nickel content produces no effect at all and there is no improvement in the mechanical strength. But, when the nickel content exceeds 2.0%, the pearlite content increases and the impact strength and the elongation are impaired.

When the chromium content exceeds 0.1%, carbides tend to precipitate and the impact strength and elongation properties are impaired.

When the magnesium content is less than 0.02%, no spheroidizing takes place. On the other hand, when the magnesium content is greater than 0.06%, not only voids and carbides tend to be produced but also an economical disadvantage arises.

When the CE (carbon equivalent) value is less than 3.9%, carbides tend to be produced and the castability is impaired. When the CE value exceeds 4.6%, kish graphite tends to be produced. The CE value is given by the following formula as proposed in "Trans. AFS", 57(1949) 24, by H. T. Angus, F. Dunn and D. Marles:

CE=Total Carbon % +(Silicon % +Phosphorus %)/3

When the remaining content of bismuth is less than 0.0015%, its effect to increase the number of graphite nodules becomes insufficient and cementite is present in the cast iron before heat treatment. When the remaining content of bismuth exceeds 0.015%, the bismuth tends to block the spheroidization of graphite and the spheroidization ratio falls below 70% with the result that various mechanical properties of the cast iron are substantially impaired.

Since the solubility of bismuth to molten nodular cast iron is poor and could vary a great deal, the amount of bismuth to be added is required be selected in the range of 0.005 to 0.030% to cause the remaining bismuth content to be in the range of 0.0015 to 0.0150%.

When the number of graphite nodules is less than 300 pre $mm^2$, the distances between graphite nodules become so great that the precipitation of pearlite becomes excessive and the impact strength and the elongation are both impaired.

According to the present invention, there is provided nodular cast iron having a high tensile strength, yield strength and impact strength and a large elongation, in particular a high impact strength at temperatures at about −40 ° C., even without performing any after treatment. If ferritizing is performed on this nodular cast iron, an even higher impact strength and greater elongation can be obtained.

BRIEF DESCRIPTION OF THE DRAWINGS

Now the present invention is described in the following with reference to the appended drawings, in which.

DETAILED DESCRIPTION OF THE PREFERRED EMBODIMENTS

In the following description, all the percentages of the various components are given by weight.

[Embodiment 1]

(1) Chemical composition

| Samples | C | Si | Mn | P | Ni | Cr | Mg | CE |
|---|---|---|---|---|---|---|---|---|
| | | | | | | | (weight %) | |
| Invention (1) | 3.71 | 2.21 | 0.19 | 0.025 | 0.53 | 0.03 | 0.037 | 4.45 |
| Invention (2) | 3.65 | 2.18 | 0.18 | 0.024 | 1.05 | 0.03 | 0.037 | 4.38 |
| Invention (3) | 3.72 | 2.16 | 0.17 | 0.029 | 1.98 | 0.03 | 0.038 | 4.44 |

-continued

| Samples | C | Si | Mn | P | Ni | Cr | Mg | CE |
|---|---|---|---|---|---|---|---|---|
| | | | | | | | (weight %) | |
| FCD40 (for comparison) | 3.71 | 2.72 | 0.31 | 0.030 | — | 0.05 | 0.034 | 4.61 |
| FCD60 (for comparison) | 3.68 | 2.81 | 0.42 | 0.029 | — | 0.06 | 0.039 | 4.62 |

(2) Mold

The samples were prepared by casting a Y-block (defined in JIS G5502) having a thickness of 25 mm and a length of 250 mm in a carbon dioxide hardened sand mold.

(3) Results

The results of the test conducted on the test pieces which were cast in the above mentioned mold are described in the following.

FIGS. 1(*a*), 1(*b*), 1(*c*), 1(*d*), and 1(*e*) are microscopic photographs of the structures of the various samples. Addition of nickel causes the increase in the amount of pearlite as shown in FIGS. 1(*a*), 1(*b*) and 1(*c*). FIGS. 1(*d*) and 1(*e*) show the structures of the conventional materials FCD40 and FCD60.

Figure 1A:
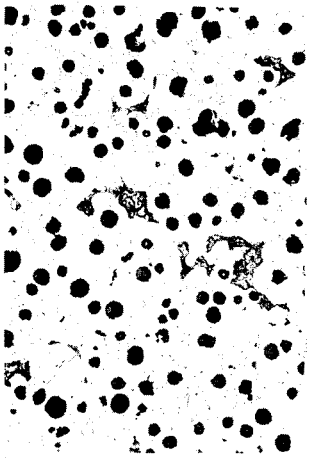
FIGS. 1(*a*), 1(*b*), 1(*c*), 1(*d*), 1(*e*), 4(*a*), 4(*b*), 4(*c*), 4(*d*), 7(*a*), 7(*b*), 7(*c*), 10(*a*), 10(*b*), 10(*c*), 13(*a*), 13(*b*), 13(*c*), 13(*d*), 17(*a*), 17(*b*), 17(*c*), 17(*d*), 17(*e*), 17(*f*), 17(*g*), 17(*h*), 17(*i*), 17(*j*), 17(*k*) and 17(*l*) are microscopic photographs of the structures of various samples and the magnification factor of the photographs of FIGS. 1, 4, 7, 10 and 13 is x 100 (one hundred), and the magnification factor of the photographs of FIGS. 17 is ×50 (fifty)
Figure 1B:
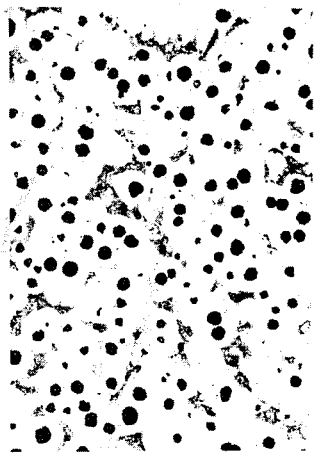
Figure 1C:
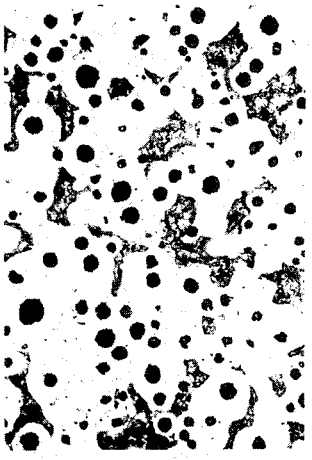
Figure 1C:
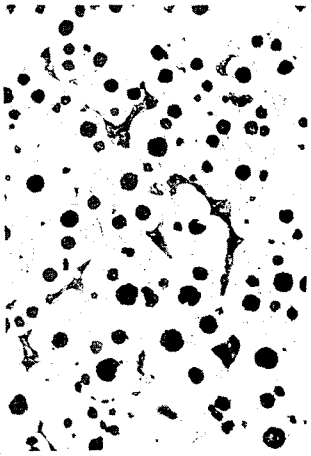
Figure 1E:
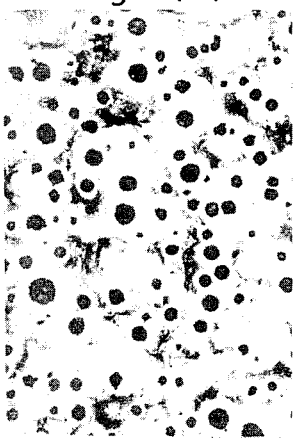
Figure 2:
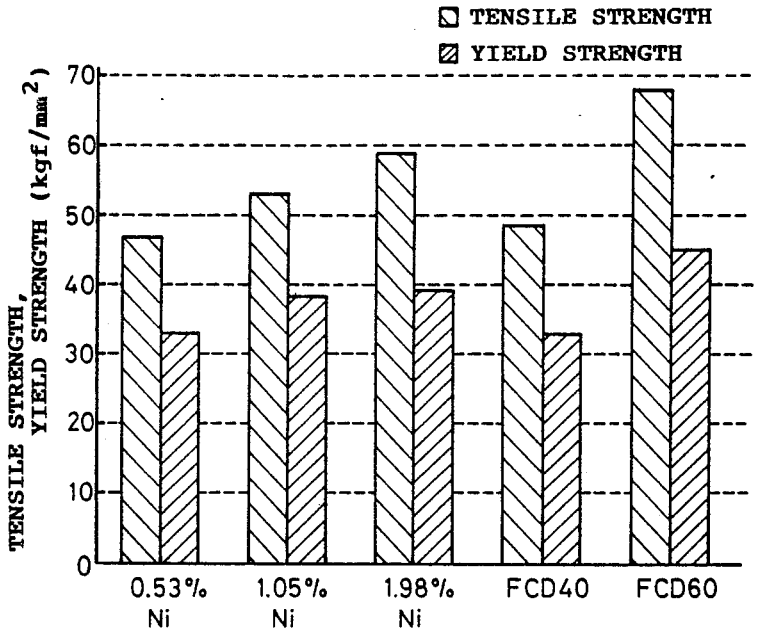
FIGS. 2, 3, 5, 6, 8, 9, 11, 12, 14 and 15 are graphs showing the mechanical properties the samples given in the photographs.
Figure 3:
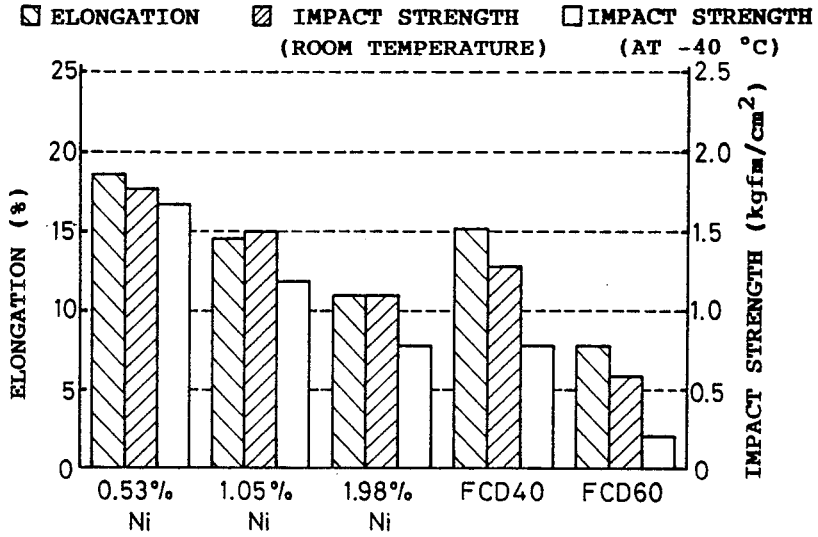
Figure 4A:
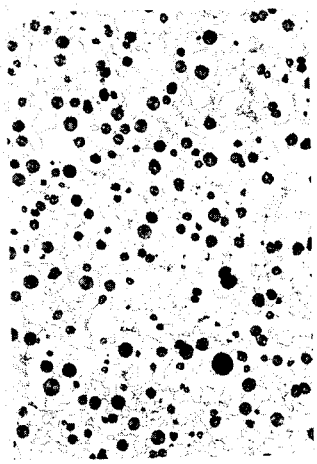
Figure 4B:
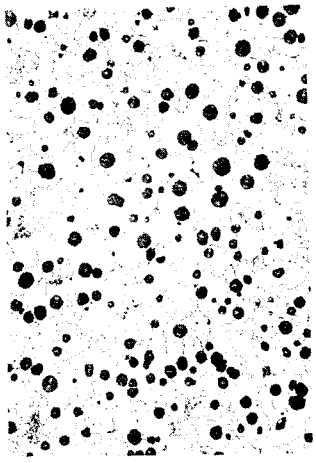
Figure 4C:
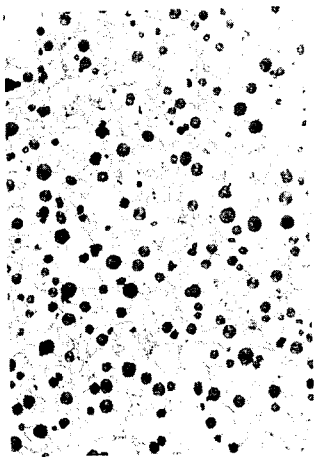
Figure 4D:
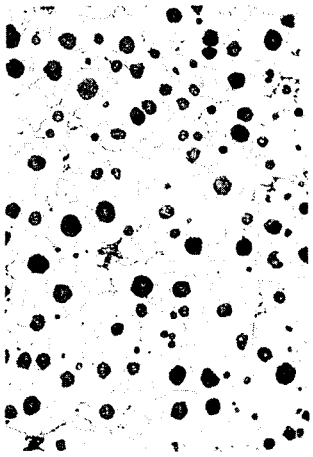

FIGS. 2 and 3 show the mechanical properties of the samples and one can see that the 0.53% nickel material of the present invention demonstrates a larger elongation and a higher impact strength but a lower tensile strength and a lower yield strength than FCD40.

The tensile strength, the yield strength and the elongation of the 1.05% nickel material of the present invention are slightly higher than those of FCD40 and some improvement can be seen in its impact strength. Of course, it demonstrates an elongation and impact strength which are far greater than those of FCD60.

The 1.98% nickel material of the present invention demonstrates a higher tensile strength but a slightly less elongation and impact strength than FCD40. This material of the present invention demonstrates lower tensile strength and yield strength but a greater elongation and higher impact strength than FCD60.

Thus, the materials of the present invention are far more superior than the conventional materials.

[Embodiment 2]

(1) Chemical composition

Same as Embodiment 1.

(2) Heat treatment

The materials (excluding FCD60) obtained in [Embodiment 1]are ferritized according to the following heat treatment cycle.

900° C. x two hours

720° C. x two hours (3) Results

Figure 5:
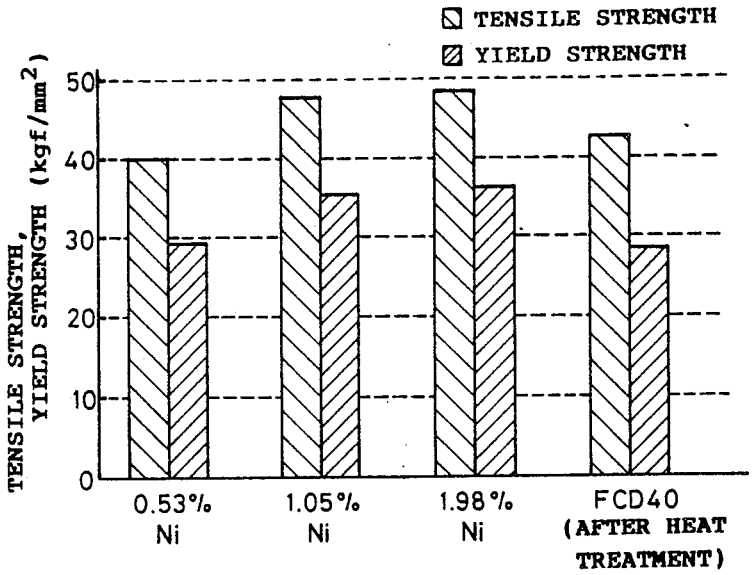
Figure 6:
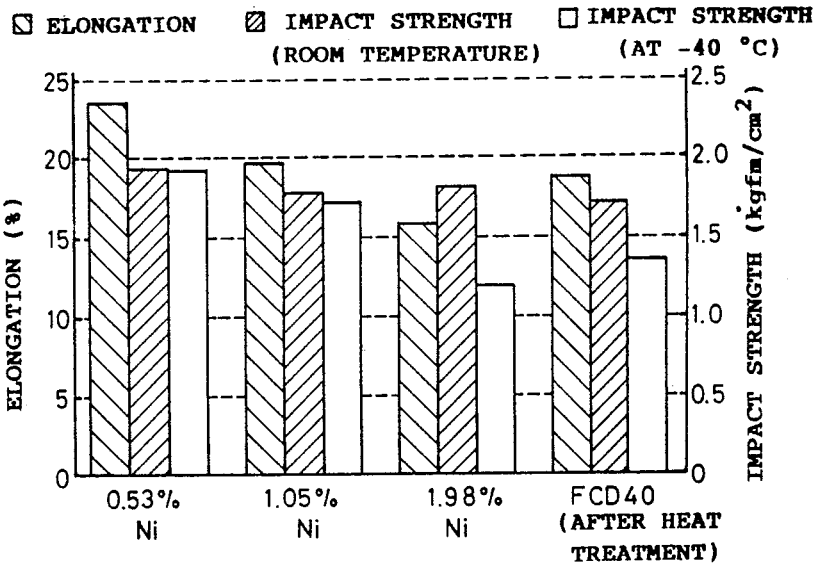

FIGS. 4(*a*), 4(*b*), 4(*c*) and 4(*d*) are microscopic photographs of the structures of the various samples. Although the nickel content was increased to 1.98%, the materials of the present invention were completely ferritized as shown in FIGS. 4(*a*), 4(*b*) and 4(*c*). FIG. 4(*d*) shows the conventional material FCD40 (after heat treatment). The mechanical properties after heat treatment are shown in FIGS. 5 and 6.

The 0.53% nickel material has a tensile strength and yield strength which are similar to those of heat treated FCD40 but has a far more improved elongation and impact strength than the latter. In particular, the impact strength of the material of the present invention is much improved at low temperatures (−40° C.).

The 1.05% nickel material has a very high tensile strength and yield and a fairly high elongation and impact strength. In particular, it has a very much improved low temperature impact strength.

The 1.98% nickel material has a slightly lower elongation and impact strength but has a much improved tensile strength and yield strength.

[Embodiment 3]

(1) Chemical composition

| Samples | C | Si | Mn | P | Ni | Cr | Mg | CE | Bi | (weight %) Bi added |
|---|---|---|---|---|---|---|---|---|---|---|
| (1)* | 3.64 | 2.04 | 0.18 | 0.028 | 0.51 | 0.03 | 0.041 | 4.32 | 0.0027 | 0.02 |
| (2)* | 3.70 | 2.27 | 0.17 | 0.028 | 1.03 | 0.03 | 0.036 | 4.46 | 0.0035 | 0.02 |
| (3)* | 3.70 | 2.24 | 0.17 | 0.030 | 2.00 | 0.03 | 0.038 | 4.44 | 0.0030 | 0.02 |

*sample materials according to the present invention (2) Mold

The samples were prepared by casting a Y-block having a thickness of 25 mm and a length of 250 mm in a carbon dioxide hardened sand mold.

(3) Results

The results of the tests conducted on the test pieces which were cast in the above mentioned mold are described in the following.

Figure 7A:
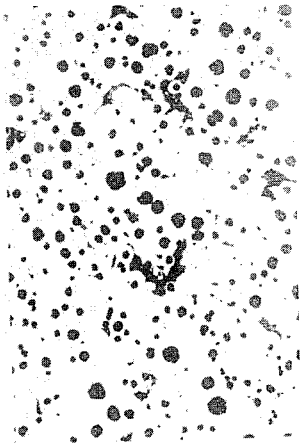
Figure 7B:
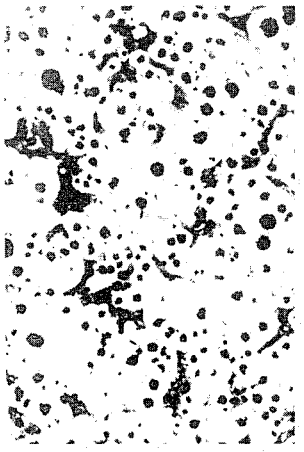
Figure 7C:
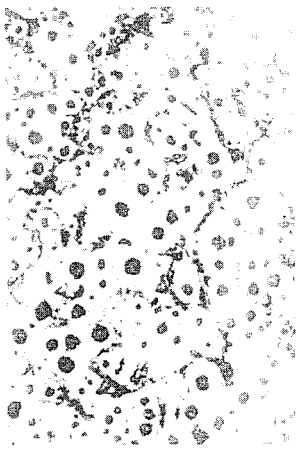

FIGS. 7(*a*), 7(*b*) and 7(*c*) are microscopic photographs of the structures of the various samples. Addition of nickel causes an increase in the amount of pearlite as shown in FIGS. 7(*a*), 7(*b*) and 7(*c*). FCD40 and FCD60 have fewer numbers of nodules than the materials of the present invention. This is because Bi was added to the materials of the present invention and the numbers of graphite nodules were thereby increased.

Figure 8:
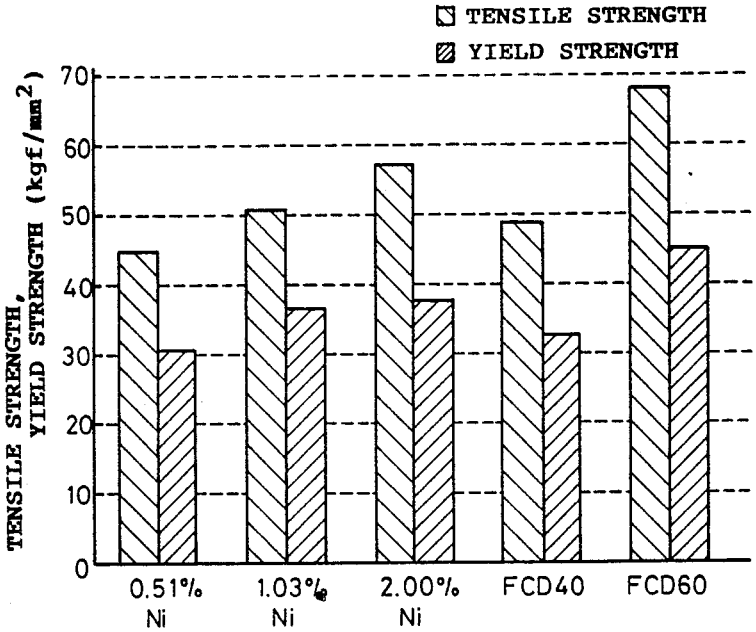
Figure 9:
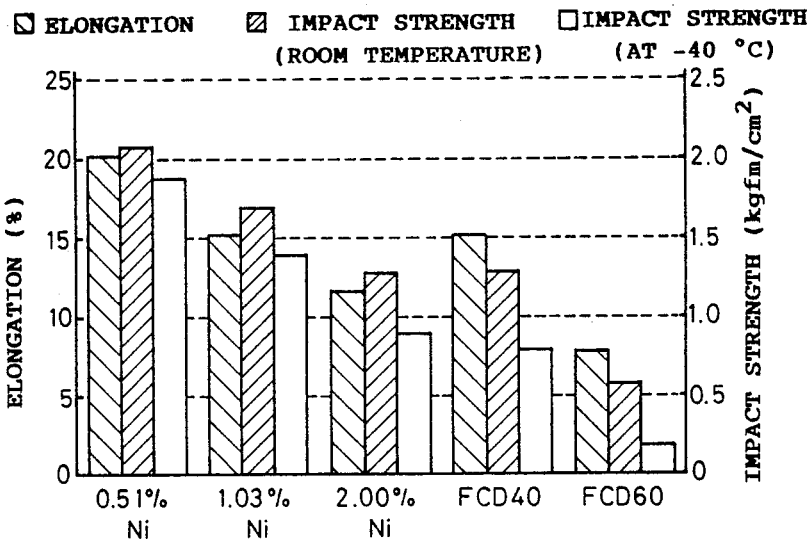

FIGS. 8 and 9 show the mechanical properties of the samples and one can see that the 0.51% nickel material demonstrates a far greater elongation and impact strength but a slightly less tensile strength and yield strength than FCD40.

The tensile strength, the yield strength and the elongation of the 1.03% nickel material of the present invention are similar to those of FCD40 but the material of the present invention shows an extremely high impact strength. Of course, it demonstrates an elongation and impact strength which are far greater than those of FCD60.

The 2.00% nickel material of the present invention demonstrates a higher tensile strength and yield strength but a slightly less elongation and impact strength than FCD40. The material of the present invention demonstrates a slightly lower tensile strength and yield strength but a greater elongation and higher impact strength than FCD60.

Thus, the materials of the present invention are far more superior than the conventional materials.

[Embodiment 4]

(1) Chemical composition

Same as Embodiment 3.

(2) Heat treatment

The materials (excluding FCD60) obtained in [Embodiment 3]are ferritized according to the following heat treatment cycle.

900° C. x two hours
720° C. x two hours
furnace cooling (3) Results

Figure 10A:
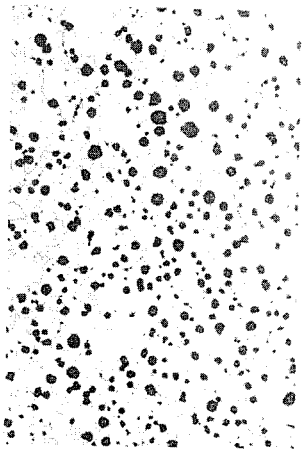
Figure 10B:
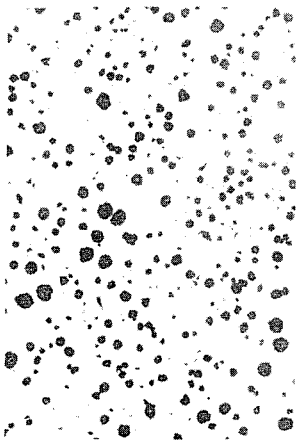
Figure 10C:
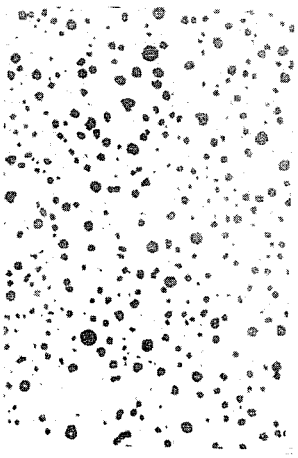

FIGS. 10(*a*), 10(*b*) and 10(*c*) are microscopic photographs of the structures of the various samples. Although the nickel content was increased to 2.0%, the materials of the present invention were completely ferritized as shown in FIGS. 10(*a*), 10(*b*) and 10(*c*). Additionally, one can see that the numbers of graphite nodules of the materials of the present invention, even when they are heat treated, are greater than that of heat treated FCD40.

Figure 11:
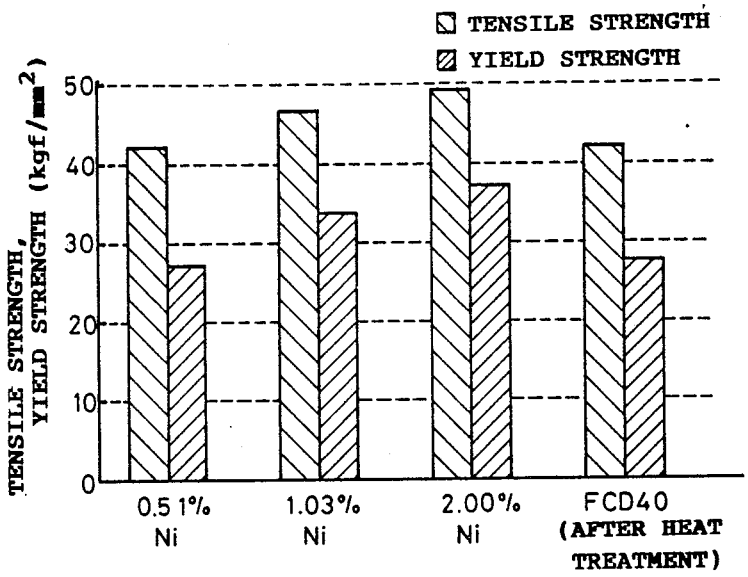
Figure 12:
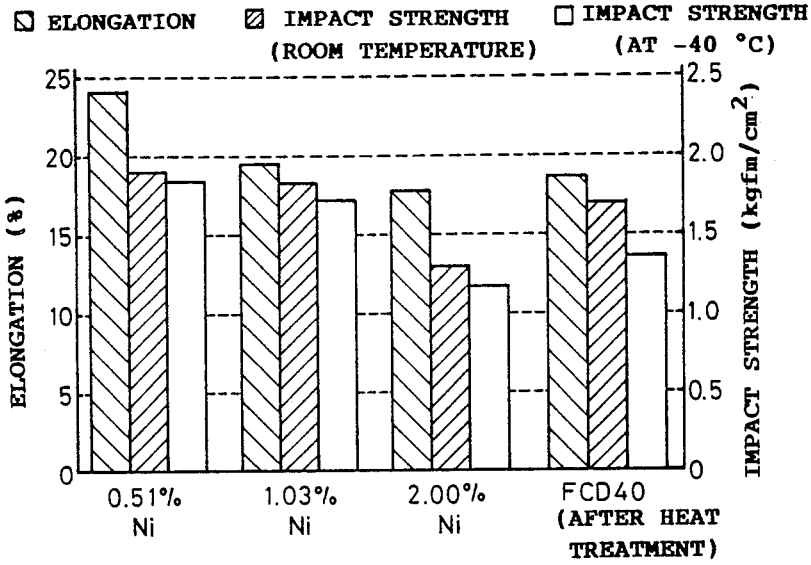
Figure 13A:
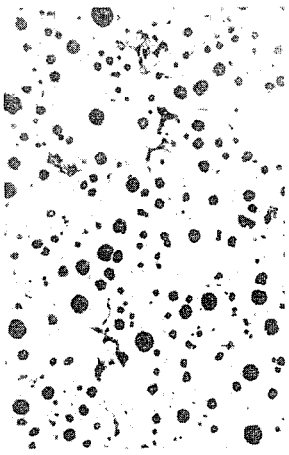
Figure 13B:
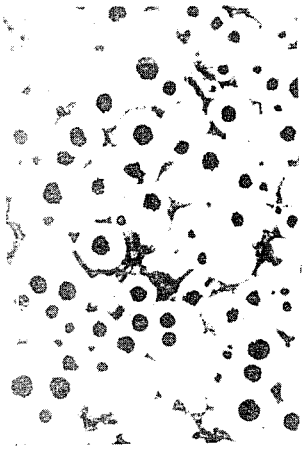
Figure 13C:
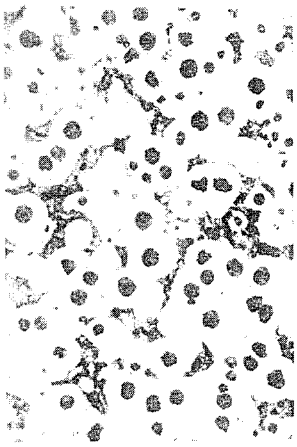
Figure 13D:
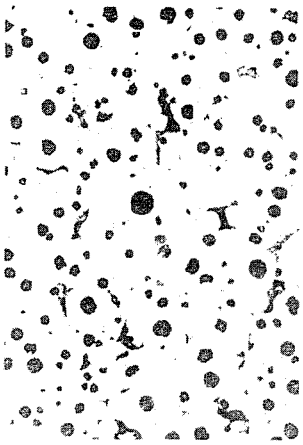

FIGS. 11 and 12 show the mechanical properties of the materials of the present invention.

The 0.51% nickel material has a tensile strength and yield strength which are similar to those of heat treated FCD40 but has a far more improved elongation and impact strength as compared to the latter. In particular, the impact strength of the material of the present invention is much improved at low temperatures (−40° C.).

The 2.00% nickel material has a slightly reduced elongation and impact strength but has a much improved tensile strength and yield strength.

[Embodiment 5]

(1) Chemical composition

| Samples | C | Si | Mn | P | Cr | Mg | CE | Bi | (weight %) Bi added |
|---|---|---|---|---|---|---|---|---|---|
| Invention | 3.58 | 2.27 | 0.17 | 0.030 | 0.04 | 0.035 | 4.34 | 0.0026 | 0.02 |
| FCD40* | 3.69 | 2.74 | 0.31 | 0.030 | 0.05 | 0.036 | 4.60 | — | — |
| FCD40 -low Si* | 3.57 | 2.28 | 0.32 | 0.030 | 0.04 | 0.037 | 4.33 | — | — |

*for comparison (2) Mold

The samples were prepared by casting a Y-block having a thickness of 25 mm and a length of 250 mm in a carbon dioxide hardened sand mold.

(3) Results

The results of the tests conducted on the test pieces which were cast in the above mentioned mold are described in the following.

FIGS. 13(*a*), 13(*b*), 13(*c*) and 13(*d*) are microscopic photographs of the structures of the various samples. One can see that the material of the present invention shown in FIGS. 13(*a*) has a large number of graphite nodules and a large amount of ferrite. On the other hand, ordinary FCD40 shown in FIGS. 13(*b*) has fewer graphite nodules and a large amount of pearlite. FCD40 having a low silicon content shown in FIGS. 13(*c*) has fewer graphite nodules and an extremely large amount of pearlite. FCD40 having bismuth added thereto, shown in FIGS. 13(*d*), has a greater number of graphite nodules and a larger amount of ferrite.

Figure 14:
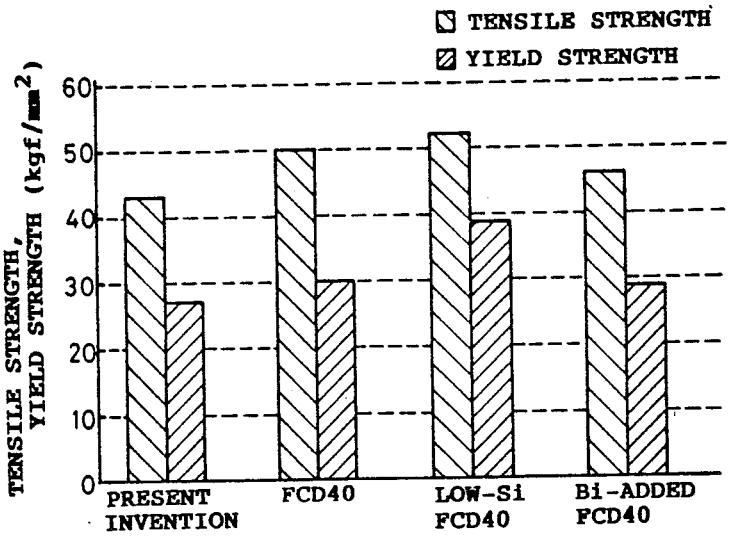
Figure 15:
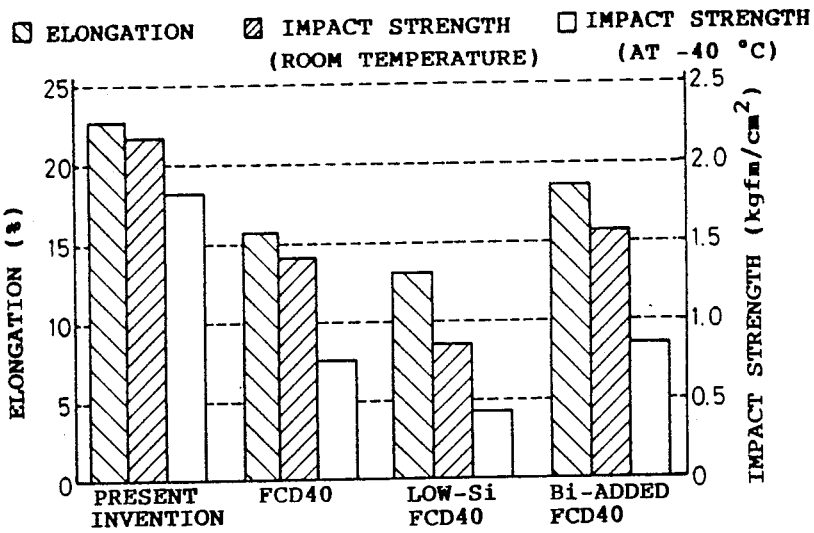

FIGS. 14 and 15 show the mechanical properties of the samples and one can see that the material of the present invention has a lower tensile strength and yield strength but a greater elongation and higher impact strength; in particular, the impact strength is as high as 1.7 kgf-m/cm$^2$ even at −40° C.

The low Si FCD40 has a higher tensile strength and yield strength due to the increase in the amount of pearlite in its microscopic structure but has an extremely reduced impact strength. The FCD40 of a normal Si content, however, having bismuth added thereto has a greater amount of ferrite in which graphite is finely distributed in its microscopic structure, but has a less elongation and a lower impact strength as compared to the low Si material of the present invention. In particular, there is no significant improvement in the impact strength at the low temperature of −40° C.

Figure 16:
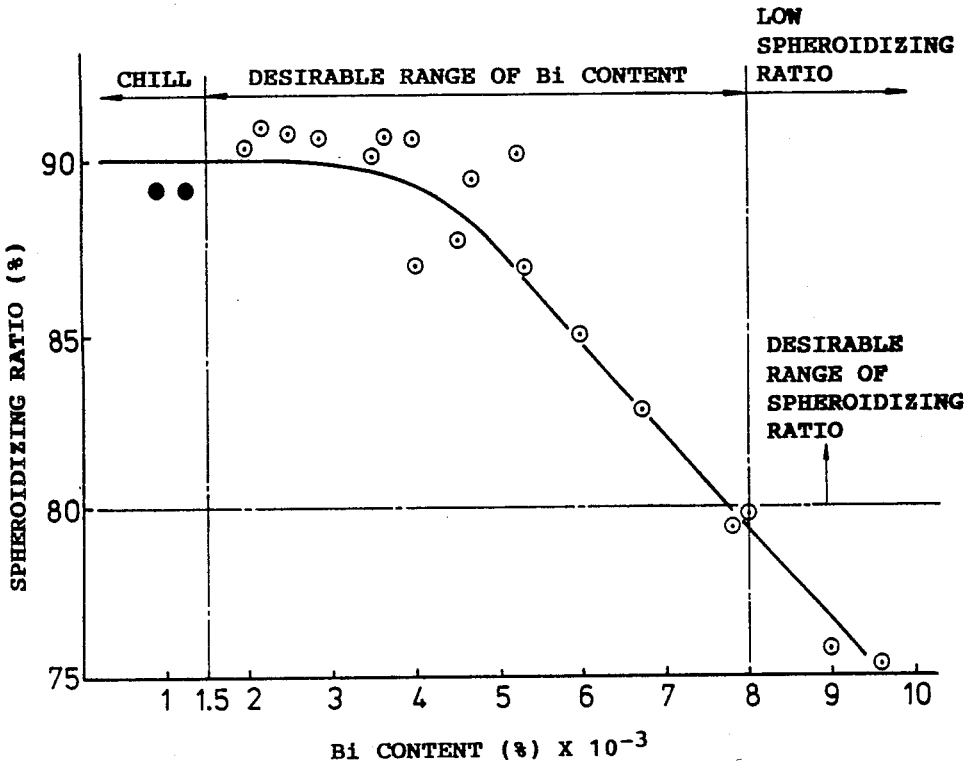
FIG. 16 is a graph showing the relationship between the bismuth content and the spheroidizing ratio of nodular cast iron of a certain composition, the numerical values given in FIGS. 17(a) through 17(l) indicating the Bi contents and the spheroidizing ratios (in brackets), respectively.
Figure 17A:
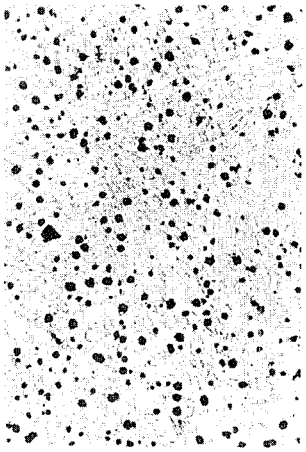
Figure 17B:
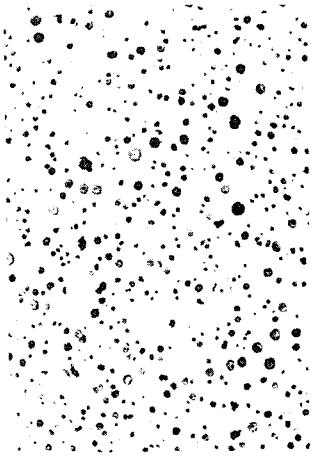
Figure 17C:
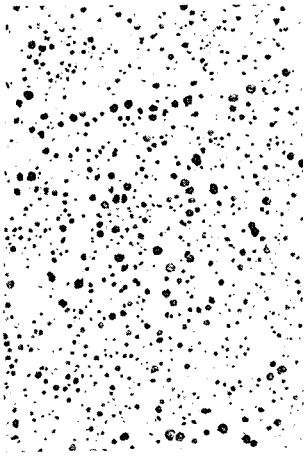
Figure 17D:
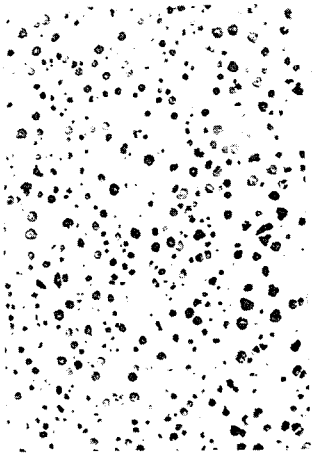
Figure 17E:
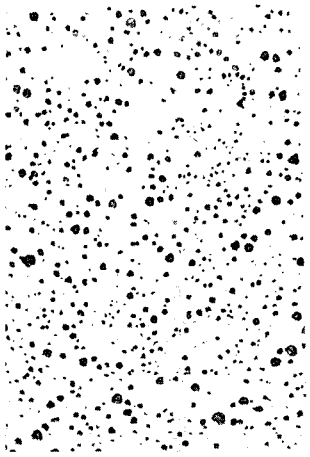
Figure 17F:
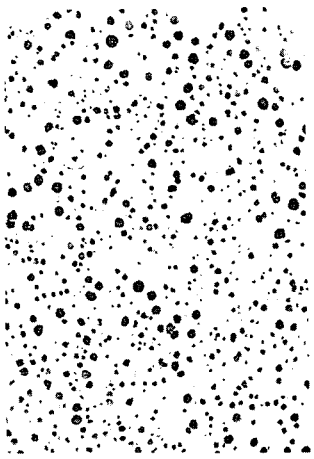
Figure 17G:
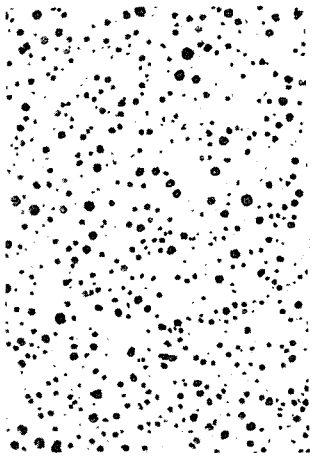
Figure 17H:
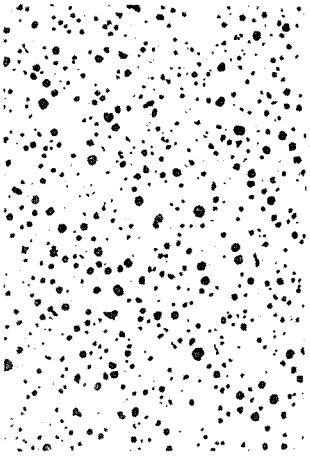
Figure 17I:
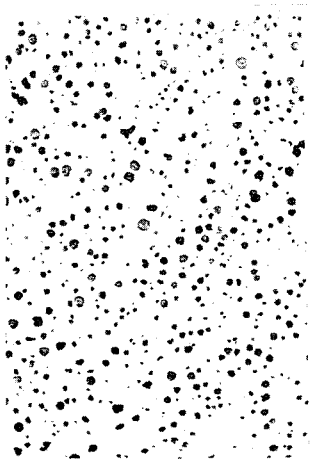
Figure 17J:
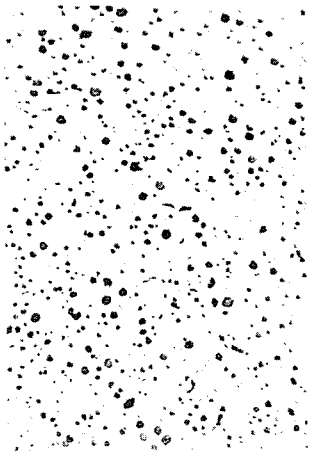
Figure 17K:
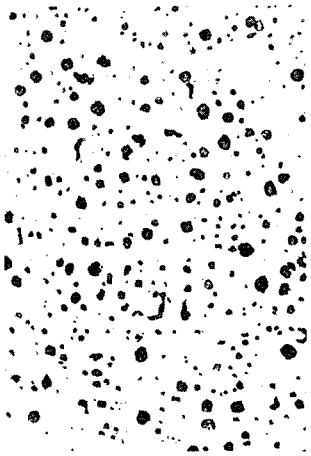
Figure 17L:
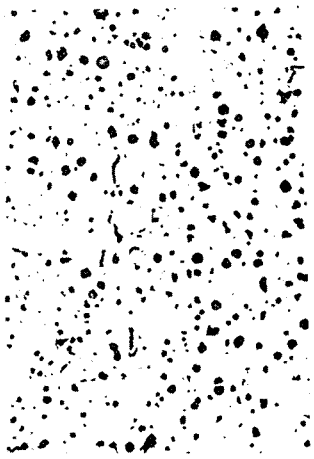

FIGS. 16 and 17(*a*) through 17(*l*) show the effect of the bismuth content on the spheroidization ratio in nodular cast iron comprising from 3.55 to 3.75% of carbon, from 2.0 to 2.3% of silicon, less than 0.3% of manganese, not more than 0.03% of phosphorus, less than 0.05% of chromium, less than 0.05% of copper, less than 0.005% of sulfur, and from 0.27 to 0.040% of magnesium, with the balance consisting of iron. According to this particular composition, the chilling occurs if the bismuth content is less than 0.0015% and the spheroidization ratio starts diminishing as the bismuth content is increased to 0.004%. In some applications, the spheroidizing ratio is desired to be greater than 80% for the nodular cast iron to have a sufficiently high low-temperature impact strength and sufficiently large elongation. If this 80% level is required, then the bismuth content must be from 0.0015 to 0.008%. In other cases, the spheroidizing ratio of a 70% level may be desired.

The relationship between the bismuth content and the spheroidizing ratio may change when the contents of other elements are varied. For instance, when the magnesium content is increased, the inclination of the curve representing the tendency of the spheroidization ratio to diminish as the bismuth content is increased becomes less. Also when the sulfur content is reduced, the inclination of the curve becomes less. Conversely, when the magnesium content is reduced and/or the sulfur content is increased, the inclination of the curve becomes greater. Generally, magnesium is considered to be helpful in increasing the spheroidizing ratio while the sulfur content is considered to be impedimental to the spheroidization. Sulfur tends to destroy graphite nodules on the one hand and consumes magnesium by forming such nonmetallic inclusions as MgS and $Mg_2S$ by reacting with magnesium. When these factors are considered, one may say that generally good results can be obtained if the bismuth content is selected from 0.0015 to 0.015%. However, as mentioned earlier, if the bismuth content is selected from 0.0015 to 0.004%, the spheroidizing ratio can be maintained at a high level without being substantially affected by the contents of magnesium and sulfur.

Thus, the materials of the present invention are far superior than the conventional materials or those improved by reduction of silicon content and addition of bismuth. Furthermore, an excellent material can be obtained without any heat treatment.

Thus, as described above, the nodular cast iron of the present invention has a superior tensile strength, elongation and impact strength without any heat treatment after casting but, when it is heat treated, its elongation and impact strength, in particular, its impacted strength at low temperatures are even further improved as compared to the one without heat treatment.

In other words, the present invention accomplishes a significant advance in the improvement in the mechanical properties of the nodular cast iron and the reduction in the manufacturing cost.

What we claim is:

1. Nodular cast iron consisting essentially of:
3.0 to 4.0 weight % of carbon;
1.5 to 2.3 weight % of silicon;
less than 0.3 weight % of manganese;
less than 0.03 weight % of phosphorus;
less than 0.10 weight % of chromium;
0.02 to 0.06 weight % of magnesium; and
0.0015 to 0.0150 weight % of bismuth;
the balance consisting of iron and inevitable impurities and the CE (carbon equivalent) value being from 3.9 to 4.6%.

2. Nodular cast iron as defined in claim 1, wherein the number of graphite nodules is greater than 300/mm$^2$.

3. Nodular cast iron as defined in claim 1, wherein the bismuth content is from 0.0015 to 0.004 weight %.

4. Nodular cast iron including graphite nodules, said iron consisting essentially of:
3.0 to 4.0 weight % of carbon;
1.5 to 2.3 weight % of silicon;
less than 0.3 weight % of manganese;
less than 0.03 weight % of phosphorus;
less than 0.10 weight % of chromium;
0.02 to 0.06 weight % of magnesium;
0.0015 to 0.0150 weight % of bismuth; and
0.5 to 201 weight % of nickel;
the balance consisting of iron and inevitable impurities and the CE (carbon equivalent) value being from 3.9 to 4.6%.

5. Nodular cast iron as defined in claim 4, wherein the number of graphite nodules is greater than 300 /mm$^2$.

6. Nodular cast iron as defined in claim 4, wherein the bismuth content is from 0.0015 to 0.004 weight %.

7. Process of treating nodular cast iron consisting essentially of 3.0 to 4.0 weight % of carbon, 1.5 to 2.3 weight % of silicon, less than 0.3 weight % of manganese, less than 0.03 weight % of phosphorus, less than 0.10 weight % of chromium, and 0.02 to 0.06 weight % of magnesium, the balance consisting essentially of iron and inevitable impurities and the CE (carbon equivalent) value being from 3.9 to 4.6%, comprising the step of:

adding from 0.005 to 0.03 weight % of bismuth to the said nodular cast iron in molten state and, either simultaneously or subsequently thereto, inoculating the nodular cast iron, so as to produce graphite nodules in a number greater than 300 per mm$^2$.

8. Process of treating nodular cast iron as defined in claim 7, wherein the amount of bismuth added to the nodular cast iron is adjusted in such a manner that the remaining bismuth content is from 0.0015 to 0.015 weight %.

9. Process of treating nodular cast iron as defined in claim 8, wherein the amount of bismuth added to the nodular cast iron is adjusted in such a manner that the remaining bismuth content is from 0.0015 to 0.004 weight %.

10. Process of treating nodular cast iron as defined in claim 7, comprising adding from 0.5 to 2.0 weight % of nickel to said nodular cast iron.

11. Process of treating nodular cast iron as defined in claim 10, wherein the amount of bismuth added to the nodular cast iron is adjusted in such a manner that the remaining bismuth content is from 0.0015 to 0.015 weight %.

12. Process of treating nodular cast iron as defined in claim 11, wherein the amount of bismuth added to the nodular cast iron is adjusted in such a manner that the remaining bismuth content is from 0.0015 to 0.004 weight %.

13. A process of treating nodular cast iron consisting essentially of 3.0 to 4.0 weight % of carbon, 1.5 to 2.3 weight % of silicon, less than 0.3 weight % of manganese, less than 0.03 weight % of phosphorus, less than 0.10 weight % of chromium, and 0.02 to 0.06 weight % of magnesium, the balance consisting essentially of iron and inevitable impurities and the CE (carbon equivalent) value being from 3.9 to 4.6%, comprising the steps of:

adding from 0.005 to 0.03 weight % of bismuth to the said nodular cast iron in molten state; and, either simultaneously or subsequently thereto, inoculating the nodular cast iron, so as to produce graphite nodules in a number greater than 300 per $mm^2$;

adding from 0.5 to 2.0 weight % of nickel to the nodular cast iron; and ferritizing the resultant nodular cast iron.

14. Process of treating nodular cast iron as defined in claim 13 wherein said ferritizing comprises a heat treatment cycle of two hours at 900° C.; two hours at 720° C.; and a furnace cooling step.

15. A process of treating nodular cast iron consisting essentially of 3.0 to 4.0 weight % of carbon, 1.5 to 2.3 weight % of silicon, less than 0.3 weight % of manganese, less than 0.03 weight % of phosphorus, less than 0.10 weight % of chromium, and 0.02 to 0.06 weight % of magnesium, the balance consisting essentially of iron and inevitable impurities and the CE (carbon equivalent) value being from 3.9 to 4.6%, comprising the steps of:

adding from 0.005 to 0.03 weight % of bismuth to the said nodular cast iron in molten state and, either simultaneously or subsequently thereto, inoculating the nodular cast iron, so as to produce graphite nodules in a number greater than 400 per $mm^2$ and ferritizing the resultant nodular cast iron.

16. Process of treating nodular cast iron as defined in claim 15 wherein said ferritizing comprises a heat treatment cycle of two hours at 900° C.; two hours at 720° C.; and a furnace cooling step.

* * * * *